US009767814B2

(12) United States Patent
Yamamoto et al.

(10) Patent No.: US 9,767,814 B2
(45) **Date of Patent: *Sep. 19, 2017**

(54) SIGNAL PROCESSING APPARATUS AND METHOD, AND PROGRAM

(71) Applicant: Sony Corporation, Tokyo (JP)

(72) Inventors: Yuki Yamamoto, Tokyo (JP); Toru Chinen, Kanagawa (JP); Mitsuyuki Hatanaka, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/206,783

(22) Filed: Jul. 11, 2016

(65) Prior Publication Data

US 2016/0322057 A1 Nov. 3, 2016

Related U.S. Application Data

(63) Continuation of application No. 13/498,234, filed as application No. PCT/JP2011/004260 on Jul. 27, 2011, now Pat. No. 9,406,306.

(30) Foreign Application Priority Data

Aug. 3, 2010 (JP) ..... 2010-174758

(51) Int. Cl.
*G10L 19/02* (2013.01)
*G10L 21/038* (2013.01)
*G10L 19/26* (2013.01)

(52) U.S. Cl.
CPC ..... *G10L 19/02* (2013.01); *G10L 19/26* (2013.01); *G10L 21/038* (2013.01)

(58) Field of Classification Search
None
See application file for complete search history.

(56) References Cited

U.S. PATENT DOCUMENTS 4,628,529 A 12/1986 Borth et al.
6,073,100 A 6/2000 Goodridge, Jr.
(Continued)

FOREIGN PATENT DOCUMENTS

CN 1328707 C 7/2007
CN 101183527 A 5/2008
(Continued)

OTHER PUBLICATIONS

U.S. Appl. No. 15/357,877, filed Nov. 21, 2016 Yamamoto et al.
(Continued)

*Primary Examiner* — Fariba Sirjani
(74) *Attorney, Agent, or Firm* — Wolf, Greenfield & Sacks, P.C.

(57) ABSTRACT

A method, system, and computer program product for processing an encoded audio signal is described. In one exemplary embodiment, the system receives an encoded low-frequency range signal and encoded energy information used to frequency shift the encoded low-frequency range signal. The low-frequency range signal is decoded and an energy depression of the decoded signal is smoothed. The smoothed low-frequency range signal is frequency shifted to generate a high-frequency range signal. The low-frequency range signal and high-frequency range signal are then combined and outputted.

3 Claims, 11 Drawing Sheets

(56) References Cited

U.S. PATENT DOCUMENTS 6,415,251 B1 7/2002 Oikawa et al.
6,708,145 B1 3/2004 Liljeryd et al.
6,829,360 B1 12/2004 Iwata et al.
6,895,375 B2 5/2005 Malah et al.
7,003,451 B2 2/2006 Kjorling et al.
7,242,710 B2 7/2007 Ekstrand
7,246,065 B2 7/2007 Tanaka et al.
7,318,035 B2 1/2008 Andersen et al.
7,330,812 B2 2/2008 Ding
7,337,118 B2 2/2008 Davidson et al.
7,447,631 B2 11/2008 Truman et al.
7,899,676 B2 3/2011 Honma et al.
7,941,315 B2 5/2011 Matsuo
7,974,847 B2 7/2011 Kjoerling et al.
7,983,424 B2 7/2011 Kjorling et al.
7,991,621 B2 8/2011 Oh et al.
8,019,614 B2 9/2011 Takagi et al.
8,032,387 B2 10/2011 Davidson et al.
8,050,933 B2 11/2011 Davidson et al.
8,063,809 B2 11/2011 Liu et al.
8,078,474 B2 12/2011 Vos et al.
8,145,475 B2 3/2012 Kjoerling et al.
8,260,609 B2 9/2012 Rajendran et al.
8,321,229 B2 11/2012 Choo et al.
8,346,566 B2 1/2013 Kjoerling et al.
8,352,249 B2 1/2013 Chong et al.
8,370,133 B2 2/2013 Taleb et al.
8,407,046 B2 3/2013 Gao
8,423,371 B2 4/2013 Yamanashi et al.
8,433,582 B2 4/2013 Ramabadran et al.
8,463,599 B2 6/2013 Ramabadran et al.
8,463,602 B2 6/2013 Oshikiri
8,484,036 B2 7/2013 Vos
8,527,283 B2 9/2013 Jasiuk et al.
8,560,330 B2 10/2013 Gao
8,688,441 B2 4/2014 Ramabadran et al.
8,793,126 B2 7/2014 Gao
8,818,541 B2 8/2014 Villemoes et al.
8,949,119 B2 2/2015 Yamamoto et al.
9,177,563 B2 11/2015 Yamamoto et al.
9,208,795 B2 12/2015 Yamamoto et al.
9,294,062 B2 3/2016 Hatanaka et al.
9,361,900 B2 6/2016 Yamamoto et al.
9,390,717 B2 7/2016 Yamamoto et al.
9,406,306 B2 * 8/2016 Yamamoto ..... G10L 21/038
9,406,312 B2 8/2016 Yamamoto et al.
9,437,197 B2 9/2016 Honma et al.
9,437,198 B2 9/2016 Hatanaka et al.
9,536,542 B2 1/2017 Yamamoto et al.
9,583,112 B2 2/2017 Yamamoto et al.
2003/0093278 A1 5/2003 Malah
2003/0187663 A1 10/2003 Truman et al.
2003/0233234 A1 * 12/2003 Truman ..... G10L 21/038
704/203
2004/0028244 A1 2/2004 Tsushima et al.
2006/0106620 A1 5/2006 Thompson et al.
2006/0136199 A1 6/2006 Nongpiur et al.
2006/0251178 A1 11/2006 Oshikiri
2006/0271356 A1 11/2006 Vos
2007/0071116 A1 3/2007 Oshikiri
2007/0150267 A1 6/2007 Honma et al.
2007/0165869 A1 7/2007 Ojanpera
2008/0027733 A1 1/2008 Oshikiri et al.
2008/0120118 A1 5/2008 Choo et al.
2008/0129350 A1 6/2008 Mitsufuji et al.
2008/0262835 A1 10/2008 Oshikiri
2008/0263285 A1 10/2008 Sharma et al.
2008/0270125 A1 10/2008 Choo et al.
2009/0048846 A1 2/2009 Smaragdis et al.
2009/0132238 A1 5/2009 Sudhakar
2009/0157413 A1 6/2009 Oshikiri
2009/0234657 A1 9/2009 Takagi et al.
2009/0248407 A1 10/2009 Oshikiri
2009/0265167 A1 10/2009 Ehara et al.
2009/0281811 A1 11/2009 Oshikiri et al.
2010/0063812 A1 3/2010 Gao
2010/0161323 A1 6/2010 Oshikiri
2010/0198587 A1 8/2010 Ramabadran et al.
2010/0198588 A1 8/2010 Sudo et al.
2010/0228557 A1 9/2010 Chen et al.
2010/0241437 A1 9/2010 Taleb et al.
2010/0280833 A1 11/2010 Yamanashi et al.
2010/0286990 A1 11/2010 Biswas et al.
2010/0318350 A1 12/2010 Endo et al.
2011/0046965 A1 2/2011 Taleb et al.
2011/0054911 A1 3/2011 Baumgarte et al.
2011/0075855 A1 3/2011 Oh et al.
2011/0106529 A1 5/2011 Disch
2011/0112845 A1 5/2011 Jasiuk et al.
2011/0137643 A1 6/2011 Yamanashi et al.
2011/0153318 A1 6/2011 Rossello et al.
2011/0170711 A1 7/2011 Rettelbach et al.
2011/0173006 A1 7/2011 Nagel et al.
2011/0178807 A1 7/2011 Yang et al.
2011/0264454 A1 * 10/2011 Ullberg ..... G10L 21/038
704/500
2011/0282675 A1 11/2011 Nagel et al.
2012/0010880 A1 1/2012 Nagel et al.
2012/0016667 A1 1/2012 Gao
2012/0057711 A1 3/2012 Makino et al.
2012/0243526 A1 9/2012 Yamamoto et al.
2012/0328124 A1 12/2012 Kjoerling
2013/0028427 A1 1/2013 Yamamoto et al.
2013/0030818 A1 1/2013 Yamamoto et al.
2013/0124214 A1 5/2013 Yamamoto et al.
2013/0202118 A1 8/2013 Yamamoto et al.
2013/0208902 A1 8/2013 Yamamoto et al.
2013/0218577 A1 8/2013 Taleb et al.
2013/0226598 A1 8/2013 Laaksonen et al.
2013/0275142 A1 * 10/2013 Hatanaka ..... G10L 19/008
704/500
2014/0006037 A1 1/2014 Honma et al.
2014/0172433 A2 6/2014 Honma et al.
2014/0180682 A1 * 6/2014 Shi ..... G10L 21/0216
704/207
2014/0200899 A1 7/2014 Yamamoto et al.
2014/0200900 A1 7/2014 Yamamoto et al.
2014/0205101 A1 7/2014 Yamamoto et al.
2014/0205111 A1 * 7/2014 Hatanaka ..... H03G 5/025
381/103
2014/0211948 A1 * 7/2014 Hatanaka ..... G10L 19/008
381/22
2014/0214432 A1 * 7/2014 Hatanaka ..... G10L 19/008
704/500
2014/0222434 A1 8/2014 Nagel et al.
2014/0226822 A1 8/2014 Engdegard et al.
2015/0088528 A1 * 3/2015 Toguri ..... G10L 19/005
704/500
2015/0120307 A1 4/2015 Yamamoto et al.
2015/0243295 A1 8/2015 Truman et al.
2016/0012829 A1 1/2016 Yamamoto et al.
2016/0019911 A1 1/2016 Yamamoto et al.
2016/0140982 A1 5/2016 Yamamoto et al.
2017/0076737 A1 * 3/2017 Yamamoto ..... G10L 19/008

FOREIGN PATENT DOCUMENTS

JP 2001-134287 A1 5/2001
JP 2001-521648 11/2001
JP 2002-536679 10/2002
JP 2003-514267 4/2003
JP 2003-316394 A 11/2003
JP 2005-520219 7/2005
JP 2008-139844 A 6/2008
JP 2008-158496 A 7/2008
JP 2009-116275 A1 5/2009
WO WO 2004/010415 1/2004
WO WO 2007/037361 4/2007

(56) References Cited

FOREIGN PATENT DOCUMENTS

| | | |
|---|---|---|
| WO | WO 2009/029037 | 3/2009 |
| WO | WO 2009/054393 A1 | 4/2009 |
| WO | WO 2010/003539 A1 | 1/2010 |

OTHER PUBLICATIONS

Extended European Search Report from the Europe Patent Office in International Application No. PCT/JP2011/004260, mailed Dec. 20, 2013 (6 pages).
U.S. Appl. No. 15/424,741, filed Feb. 3, 2017, Hatanaka et al.
Abstract of International Application No. PCT/IB1998/000893, filed Jun. 9, 1998 (1 page).
Abstract of Internatonal Application No. PCT/JP2003/011601, filed Sep. 11, 2003 (2 pages).
Extended European Search Report from the Europe Patent Office in International Application No. PCT/JP2011/004260, dated Dec. 20, 2013 (6 pages).
Notification of Reason(s) for Refusal for International Patent Application No. 2010-174758 dated May 29, 2014 from the Japanese Patent Office.
U.S. Appl. No. 13/978,175, filed Jul. 3, 2013, Hatanaka et al.
U.S. Appl. No. 14/104,828, filed Dec. 12, 2013, Shi et al.
U.S. Appl. No. 14/238,243, filed Feb. 11, 2014, Hatanaka et al.
U.S. Appl. No. 14/239,574, filed Feb. 19, 2014, Hatanaka et al.
U.S. Appl. No. 14/239,797, filed Feb. 20, 2014, Hatanaka et al.
U.S. Appl. No. 14/390,810, filed Oct. 6, 2014, Toguri et al.
U.S. Appl. No. 15/357,877, filed Nov. 21, 2016, Yamamoto et al.
Bosi et al., ISO/IEC MPEG-2 Advanced Audio Coding, J. Audio Eng. Soc., vol. 45, No. 10, pp. 789-814.
Ekstrand, P., Bandwidth Extension of Audio Signals by Spectral Band Replication, Proc. 1st IEEE Benelux Workshop on Model based Processing and Coding of Audio (MPCA-202), Leuven, Belgium, Nov. 15, 2002, pp. 53-58.

* cited by examiner

SIGNAL PROCESSING APPARATUS AND METHOD, AND PROGRAM

CROSS REFERENCE TO RELATED APPLICATIONS

This application is a continuation of and claims the benefit under 35 U.S.C. §120 of U.S. patent application Ser. No. 13/498,234, titled "SIGNAL PROCESSING APPARATUS AND METHOD, AND PROGRAM," filed on Apr. 12, 2012, which is a U.S. National Stage Application under 35 U.S.C. §371, based on International Application No. PCT/JP2011/004260, filed on Jul. 27, 2011, which claims priority under 35 U.S.C. §119(a) to Japanese Application Ser. No. JP2010-174758, filed on Aug. 3, 2010. The entire contents of these applications are hereby incorporated by reference in their entireties.

TECHNICAL FIELD

The present disclosure relates to a signal processing apparatus and method as well as a program. More particularly, an embodiment relates to a signal processing apparatus and method as well as a program configured such that audio of higher audio quality is obtained in the case of decoding a coded audio signal.

BACKGROUND ART

Conventionally, HE-AAC (High Efficiency MPEG (Moving Picture Experts Group) 4 AAC (Advanced Audio Coding)) (International Standard ISO/IEC 14496-3), etc. are known as audio signal coding techniques. With such coding techniques, a high-range characteristics coding technology called SBR (Spectral Band Replication) is used (for example, see PTL 1).

With SBR, when coding an audio signal, coded low-range components of the audio signal (hereinafter designated a low-range signal, that is, a low-frequency range signal) are output together with SBR information for generating high-range components of the audio signal (hereinafter designated a high-range signal, that is, a high-frequency range signal). With a decoding apparatus, the coded low-range signal is decoded, while in addition, the low-range signal obtained by decoding and SBR information is used to generate a high-range signal, and an audio signal consisting of the low-range signal and the high-range signal is obtained.

More specifically, assume that the low-range signal SL1 illustrated in FIG. 1 is obtained by decoding, for example. Herein, in FIG. 1, the horizontal axis indicates frequency, and the vertical axis indicates energy of respective frequencies of an audio signal. Also, the vertical broken lines in the drawing represent scalefactor band boundaries. Scalefactor bands are bands that plurally bundle sub-bands of a given bandwidth, i.e. the resolution of a QMF (Quadrature Minor Filter) analysis filter.

In FIG. 1, a band consisting of the seven consecutive scalefactor bands on the right side of the drawing of the low-range signal SL1 is taken to be the high range. High-range scalefactor band energies E11 to E17 are obtained for each of the scalefactor bands on the high-range side by decoding SBR information.

Additionally, the low-range signal SL1 and the high-range scalefactor band energies are used, and a high-range signal for each scalefactor band is generated. For example, in the case where a high-range signal for the scalefactor band Bobj is generated, components of the scalefactor band Borg from out of the low-range signal SL1 are frequency-shifted to the band of the scalefactor band Bobj. The signal obtained by the frequency shift is gain-adjusted and taken to be a high-range signal. At this time, gain adjustment is conducted such that the average energy of the signal obtained by the frequency shift becomes the same magnitude as the high-range scalefactor band energy E13 in the scalefactor band Bobj.

According to such processing, the high-range signal SH1 illustrated in FIG. 2 is generated as the scalefactor band Bobj component. Herein, in FIG. 2, identical reference signs are given to portions corresponding to the case in FIG. 1, and description thereof is omitted or reduced.

In this way, at the audio signal decoding side, a low-range signal and SBR information is used to generate high-range components not included in a coded and decoded low-range signal and expand the band, thereby making it possible to playback audio of higher audio quality.

CITATION LIST

Patent Literature

PTL 1: Japanese Unexamined Patent Application Publication (Translation of PCT Application) No. 2001-521648

SUMMARY OF INVENTION

Disclosed is a computer-implemented method for processing an audio signal. The method may include receiving an encoded low-frequency range signal corresponding to the audio signal. The method may further include decoding the signal to produce a decoded signal having an energy spectrum of a shape including an energy depression. Additionally, the method may include performing filter processing on the decoded signal, the filter processing separating the decoded signal into low-frequency range band signals. The method may also include performing a smoothing process on the decoded signal, the smoothing process smoothing the energy depression of the decoded signal. The method may further include performing a frequency shift on the smoothed decoded signal, the frequency shift generating high-frequency range band signals from the low-frequency range band signals. Additionally, the method may include combining the low-frequency range band signals and the high-frequency range band signals to generate an output signal. The method may further include outputting the output signal.

Also disclosed is a device for processing a signal. The device may include a low-frequency range decoding circuit configured to receive an encoded low-frequency range signal corresponding to the audio signal and decode the encoded signal to produce a decoded signal having an energy spectrum of a shape including an energy depression. Additionally, the device may include a filter processor configured to perform filter processing on the decoded signal, the filter processing separating the decoded signal into low-frequency range band signals. The device may also include a high-frequency range generating circuit configured to perform a smoothing process on the decoded signal, the smoothing process smoothing the energy depression and perform a frequency shift on the smoothed decoded signal, the frequency shift generating high-frequency range band signals from the low-frequency range band signals. The device may additionally include a combinatorial circuit configured to combine the low-frequency range band signals and the high-frequency range band signals to generate an output signal, and output the output signal.

Also disclosed is tangibly embodied computer-readable storage medium including instructions that, when executed by a processor, perform a method for processing an audio signal. The method may include receiving an encoded low-frequency range signal corresponding to the audio signal. The method may further include decoding the signal to produce a decoded signal having an energy spectrum of a shape including an energy depression. Additionally, the method may include performing filter processing on the decoded signal, the filter processing separating the decoded signal into low-frequency range band signals. The method may also include performing a smoothing process on the decoded signal, the smoothing process smoothing the energy depression of the decoded signal. The method may further include performing a frequency shift on the smoothed decoded signal, the frequency shift generating high-frequency range band signals from the low-frequency range band signals. Additionally, the method may include combining the low-frequency range band signals and the high-frequency range band signals to generate an output signal. The method may further include outputting the output signal.

Technical Problem

However, in cases where there is a hole in the low-range signal SL1 used to generate a high-range signal, that is, where there is a low-frequency range signal having an energy spectrum of a shape including an energy depression used to generate a high-frequency range signal, like the scalefactor band Borg in FIG. 2, it is highly probable that the shape of the obtained high-range signal SH1 will become a shape largely different from the frequency shape of the original signal, which becomes a cause of auditory degradation. Herein, the state of there being a hole in a low-range signal refers to a state wherein the energy of a given band is markedly low compared to the energies of adjacent bands, with a portion of the low-range power spectrum (the energy waveform of each frequency) protruding downward in the drawing. In other words, it refers to a state wherein the energy of a portion of the band components is depressed, that is, an energy spectrum of a shape including an energy depression.

In the example in FIG. 2, since a depression exists in the low-range signal, that is, low-frequency range signal, SL1 used to generate a high-range signal, that is, high-frequency range signal, a depression also occurs in the high-range signal SH1. If a depression exists in a low-range signal used to generate a high-range signal in this way, high-range components can no longer be precisely reproduced, and auditory degradation can occur in an audio signal obtained by decoding.

Also, with SBR, processing called gain limiting and interpolation can be conducted. In some cases, such processing can cause depressions to occur in high-range components.

Herein, gain limiting is processing that suppresses peak values of the gain within a limited band consisting of plural sub-bands to the average value of the gain within the limited band.

For example, assume that the low-range signal SL2 illustrated in FIG. 3 is obtained by decoding a low-range signal. Herein, in FIG. 3, the horizontal axis indicates frequency, and the vertical axis indicates energy of respective frequencies of an audio signal. Also, the vertical broken lines in the drawing represent scalefactor band boundaries.

In FIG. 3, a band consisting of the seven consecutive scalefactor bands on the right side of the drawing of the low-range signal SL2 is taken to be the high range. By decoding SBR information, high-range scalefactor band energies E21 to E27 are obtained.

Also, a band consisting of the three scalefactor bands from Bobj1 to Bobj3 is taken to be a limited band. Furthermore, assume that the respective components of the scalefactor bands Borg1 to Borg3 of the low-range signal SL2 are used, and respective high-range signals for the scalefactor bands Bobj1 to Bobj3 on the high-range side are generated.

Consequently, when generating a high-range signal SH2 in the scalefactor band Bobj2, gain adjustment is basically made according to the energy differential G2 between the average energy of the scalefactor band Borg2 of the low-range signal SL2 and the high-range scalefactor band energy E22. In other words, gain adjustment is conducted by frequency-shifting the components of the scalefactor band Borg2 of the low-range signal SL2 and multiplying the signal obtained as a result by the energy differential G2. This is taken to be the high-range signal SH2.

However, with gain limiting, if the energy differential G2 is greater than the average value G of the energy differentials G1 to G3 of the scalefactor bands Bobj1 to Bobj3 within the limited band, the energy differential G2 by which a frequency-shifted signal is multiplied will be taken to be the average value G. In other words, the gain of the high-range signal for the scalefactor band Bobj2 will be suppressed down.

In the example in FIG. 3, the energy of the scalefactor band Borg2 in the low-range signal SL2 has become smaller compared to the energies of the adjacent scalefactor bands Borg1 and Borg3. In other words, a depression has occurred in the scalefactor band Borg2 portion.

In contrast, the high-range scalefactor band energy E22 of the scalefactor band Bobj2, i.e. the application destination of the low-range components, is larger than the high-range scalefactor band energies of the scalefactor bands Bobj1 and Bobj3.

For this reason, the energy differential G2 of the scalefactor band Bobj2 becomes higher than the average value G of the energy differential within the limited band, and the gain of the high-range signal for the scalefactor band Bobj2 is suppressed down by gain limiting.

Consequently, in the scalefactor band Bobj2, the energy of the high-range signal SH2 becomes drastically lower than the high-range scalefactor band energy E22, and the frequency shape of the generated high-range signal becomes a shape that greatly differs from the frequency shape of the original signal. Thus, auditory degradation occurs in the audio ultimately obtained by decoding.

Also, interpolation is a high-range signal generation technique that conducts frequency shifting and gain adjustment on each sub-band rather than each scalefactor band.

For example, as illustrated in FIG. 4, assume that the respective sub-bands Borg1 to Borg3 of the low-range signal SL3 are used, respective high-range signals in the sub-bands Bobj1 to Bobj3 on the high-range side are generated, and a band consisting of the sub-bands Bobj1 to Bobj3 is taken to be a limited band.

Herein, in FIG. 4, the horizontal axis indicates frequency, and the vertical axis indicates energy of respective frequencies of an audio signal. Also, by decoding SBR information, high-range scalefactor band energies E31 to E37 are obtained for each scalefactor band.

In the example in FIG. 4, the energy of the sub-band Borg2 in the low-range signal SL3 has become smaller compared to the energies of the adjacent sub-bands Borg1 and Borg3, and a depression has occurred in the sub-band Borg2 portion. For this reason, and similarly to the case in FIG. 3, the energy differential between the energy of the sub-band Borg2 of the low-range signal SL3 and the high-range scalefactor band energy E33 becomes higher than the average value of the energy differential within the limited band. Thus, the gain of the high-range signal SH3 in the sub-band Bobj2 is suppressed down by gain limiting.

As a result, in the sub-band Bobj2, the energy of the high-range signal SH3 becomes drastically lower than the high-range scalefactor band energy E33, and the frequency shape of the generated high-range signal may become a shape that greatly differs from the frequency shape of the original signal. Thus, similarly to the case in FIG. 3, auditory degradation occurs in the audio obtained by decoding.

As in the above, with SBR, there have been cases where audio of high audio quality is not obtained on the audio signal decoding side due to the shape (frequency shape) of the power spectrum of a low-range signal used to generate a high-range signal.

Advantageous Effects of Invention

According to an aspect of an embodiment, audio of higher audio quality can be obtained in the case of decoding an audio signal.

DESCRIPTION OF EMBODIMENTS

Figure 1:
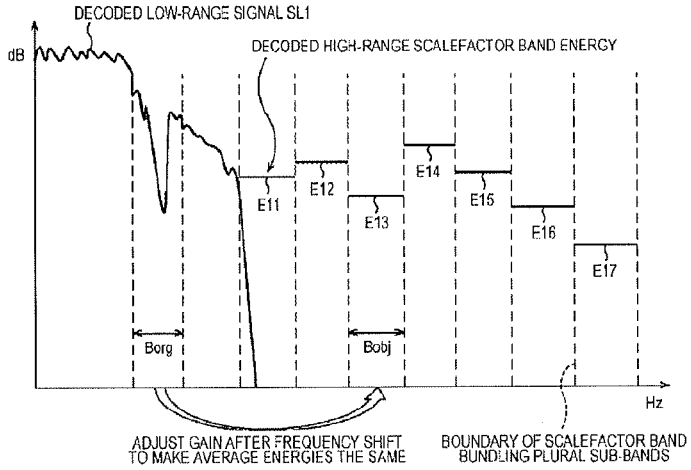
Prior Art FIG. 1
FIG. 1 is a diagram explaining conventional SBR.
Figure 2:
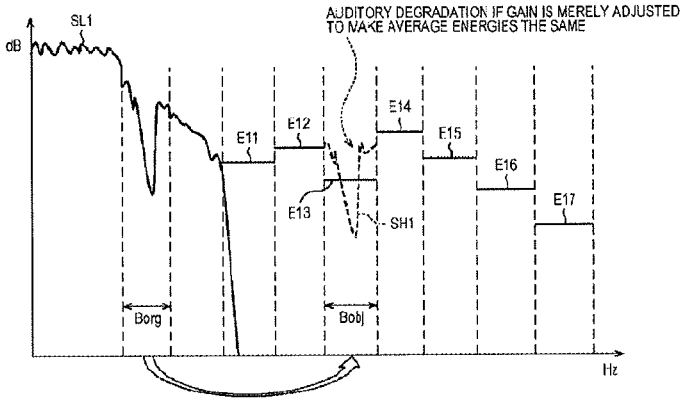
Prior Art FIG. 2
FIG. 2 is a diagram explaining conventional SBR.
Figure 3:
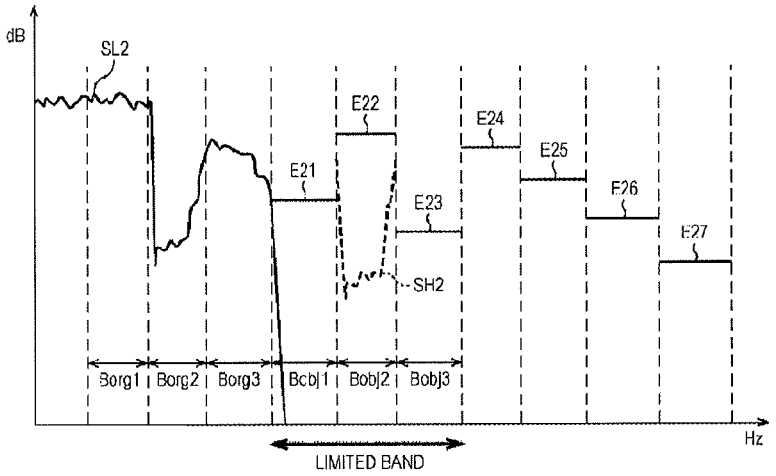
Prior Art FIG. 3
FIG. 3 is a diagram explaining conventional gain limiting.
Figure 4:
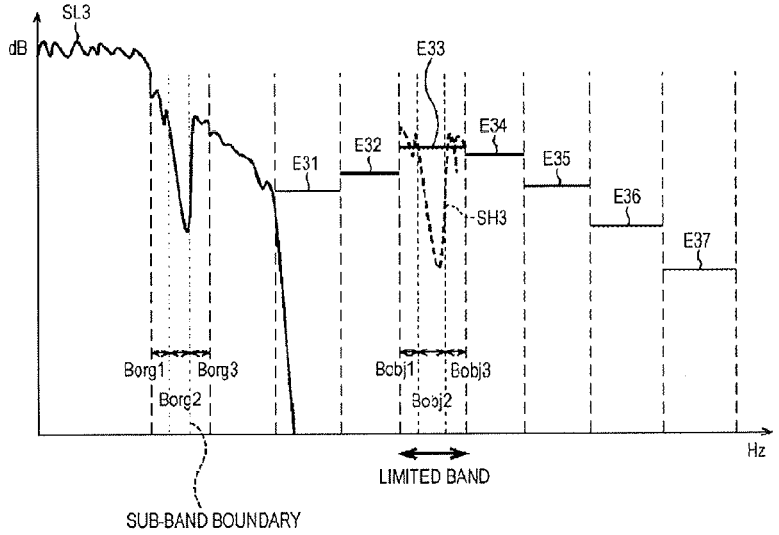
Prior Art FIG. 4
FIG. 4 is a diagram explaining conventional interpolation.

Hereinafter, embodiments will be described with reference to the drawings.

Overview of Present Invention

First, band expansion of an audio signal by SBR to which an embodiment has been applied will be described with reference to FIG. 5. Herein, in FIG. 5, the horizontal axis indicates frequency, and the vertical axis indicates energy of respective frequencies of an audio signal. Also, the vertical broken lines in the drawing represent scalefactor band boundaries.

For example, assume that at the audio signal decoding side, a low-range signal SL11 and high-range scalefactor band energies Eobj1 to Eobj7 of the respective scalefactor bands Bobj1 to Bobj7 on the high-range side are obtained from data received from the coding side. Also assume that the low-range signal SL11 and the high-range scalefactor band energies Eobj1 to Eobj7 are used, and high-range signals of the respective scalefactor bands Bobj1 to Bobj7 are generated.

Now consider that the low-range signal SL11 and the scalefactor band Borg1 component are used to generate a high-range signal of the scalefactor band Bobj3 on the high-range side.

Figure 5:
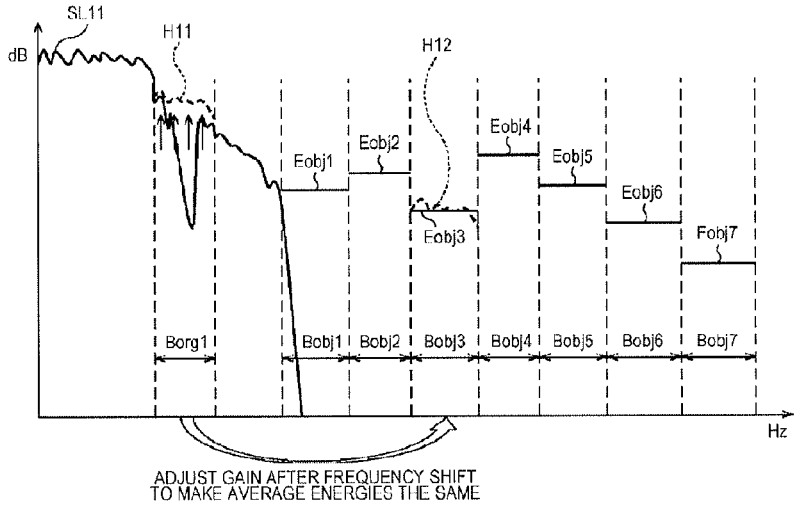
FIG. 5 is a diagram explaining SBR to which an embodiment has been applied.

In the example in FIG. 5, the power spectrum of the low-range signal SL11 is greatly depressed downward in the drawing in the scalefactor band Borg1 portion. In other words, the energy has become small compared to other bands. For this reason, if a high-range signal in scalefactor band Bobj3 is generated by conventional SBR, a depression will also occur in the obtained high-range signal, and auditory degradation will occur in the audio.

Accordingly, in an embodiment, a flattening process (i.e., smoothing process) is first conducted on the scalefactor band Borg1 component of the low-range signal SL11. Thus, a low-range signal H11 of the flattened scalefactor band Borg1 is obtained. The power spectrum of this low-range signal H11 is smoothly coupled to the band portions adjacent to the scalefactor band Borg1 in the power spectrum of the low-range signal SL11. In other words, the low-range signal SL11 after flattening, that is, smoothing, becomes a signal in which a depression does not occur in the scalefactor band Borg1.

In so doing, if flattening of the low-range signal SL11 is conducted, the low-range signal H11 obtained by flattening is frequency-shifted to the band of the scalefactor band Bobj3. The signal obtained by frequency shifting is gain-adjusted and taken to be a high-range signal H12.

At this point, the average value of the energies in each sub-band of the low-range signal H11 is computed as the average energy Eorg1 of the scalefactor band Borg1. Then, gain adjustment of the frequency-shifted low-range signal H11 is conducted according to the ratio of the average energy Eorg1 and the high-range scalefactor band energy Eobj3. More specifically, gain adjustment is conducted such that the average value of the energies in the respective sub-bands in the frequency-shifted low-range signal H11 becomes nearly the same magnitude as the high-range scalefactor band energy Eobj3.

In FIG. 5, since a depression-less low-range signal H11 is used and a high-range signal H12 is generated, the energies of the respective sub-bands in the high-range signal H12 have become nearly the same magnitude as the high-range scalefactor band energy Eobj3. Consequently, a high-range signal nearly the same as a high-range signal in the original signal is obtained.

In this way, if a flattened low-range signal is used to generate a high-range signal, high-range components of an audio signal can be generated with higher precision, and the conventional auditory degradation of an audio signal produced by depressions in the power spectrum of a low-range signal can be improved. In other words, it becomes possible to obtain audio of higher audio quality.

Also, since depressions in the power spectrum can be removed if a low-range signal is flattened, auditory degradation of an audio signal can be prevented if a flattened low-range signal is used to generate a high-range signal, even in cases where gain limiting and interpolation are conducted.

Herein, it may be configured such that low-range signal flattening is conducted on all band components on the low-range side used to generate high-range signals, or it may be configured such that low-range signal flattening is conducted only on a band component where a depression occurs from among the band components on the low-range side. Also, in the case where flattening is conducted only on a band component where a depression occurs, the band subjected to flattening may be a single sub-band if sub-bands are the bands taken as units, or a band of arbitrary width consisting of a plurality of sub-bands.

Furthermore, hereinafter, for a scalefactor band or other band consisting of several sub-bands, the average value of the energies in the respective sub-bands constituting that band will also be designated the average energy of the band.

Next, an encoder and decoder to which an embodiment has been applied will be described. Herein, in the following, a case wherein high-range signal generation is conducted taking scalefactor bands as units is described by example, but high-range signal generation may obviously also be conducted on individual bands consisting of one or a plurality of sub-bands.

First Embodiment

Encoder Configuration

Figure 6:
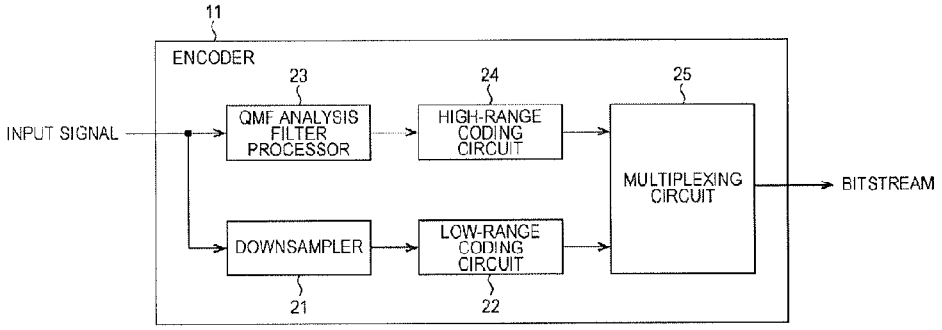
FIG. 6 is a diagram illustrating an exemplary configuration of an embodiment of an encoder to which an embodiment has been applied.

FIG. 6 illustrates an exemplary configuration of an embodiment of an encoder.

An encoder 11 consists of a downsampler 21, a low-range coding circuit 22, that is a low-frequency range coding circuit, a QMF analysis filter processor 23, a high-range coding circuit 24, that is a high-frequency range coding circuit, and a multiplexing circuit 25. An input signal, i.e. an audio signal, is supplied to the downsampler 21 and the QMF analysis filter processor 23 of the encoder 11.

By downsampling the supplied input signal, the downsampler 21 extracts a low-range signal, i.e. the low-range components of the input signal, and supplies it to the low-range coding circuit 22. The low-range coding circuit 22 codes the low-range signal supplied from the downsampler 21 according to a given coding scheme, and supplies the low-range coded data obtained as a result to the multiplexing circuit 25. The AAC scheme, for example, exists as a method of coding a low-range signal.

The QMF analysis filter processor 23 conducts filter processing using a QMF analysis filter on the supplied input signal, and separates the input signal into a plurality of sub-bands. For example, the entire frequency band of the input signal is separated into 64 by filter processing, and the components of these 64 bands (sub-bands) are extracted. The QMF analysis filter processor 23 supplies the signals of the respective sub-bands obtained by filter processing to the high-range coding circuit 24.

Additionally, hereinafter, the signals of respective sub-bands of the input signal are taken to also be designated sub-band signals. Particularly, taking the bands of the low-range signal extracted by the downsampler 21 as the low range, the sub-band signals of respective sub-bands on the low-range side are designated low-range sub-band signals, that is, low-frequency range band signals. Also, taking the bands of higher frequency than the bands on the low-range side from among all bands of the input signal as the high range, the sub-band signals of the sub-bands on the high-range side are taken to be designated high-range sub-band signals, that is, high-frequency range band signals.

Furthermore, in the following, description taking bands of higher frequency than the low range as the high range will continue, but a portion of the low range and the high range may also be made to overlap. In other words, it may be configured such that bands mutually shared by the low range and the high range are included.

The high-range coding circuit 24 generates SBR information on the basis of the sub-band signals supplied from the QMF analysis filter processor 23, and supplies it to the multiplexing circuit 25. Herein, SBR information is information for obtaining the high-range scalefactor band energies of the respective scalefactor bands on the high-range side of the input signal, i.e. the original signal.

The multiplexing circuit 25 multiplexes the low-range coded data from the low-range coding circuit 22 and the SBR information from the high-range coding circuit 24, and outputs the bitstream obtained by multiplexing.

Description of Coding Process

Meanwhile, if an input signal is input into the encoder 11 and coding of the input signal is instructed, the encoder 11 conducts a coding process and conducts coding of the input signal. Hereinafter, a coding process by the encoder 11 will be described with reference to the flowchart in FIG. 7.

In a step S11, the downsampler 21 downsamples a supplied input signal and extracts a low-range signal, and supplies it to the low-range coding circuit 22.

In a step S12, the low-range coding circuit 22 codes the low-range signal supplied from the downsampler 21 according to the AAC scheme, for example, and supplies the low-range coded data obtained as a result to the multiplexing circuit 25.

In a step S13, the QMF analysis filter processor 23 conducts filter processing using a QMF analysis filter on the supplied input signal, and supplies the sub-band signals of the respective sub-bands obtained as a result to the high-range coding circuit 24.

In a step S14, the high-range coding circuit 24 computes a high-range scalefactor band energy Eobj, that is, energy information, for each scalefactor band on the high-range side, on the basis of the sub-band signals supplied from the QMF analysis filter processor 23.

In other words, the high-range coding circuit 24 takes a band consisting of several consecutive sub-bands on the high-range side as a scalefactor band, and uses the sub-band signals of the respective sub-bands within the scalefactor band to compute the energy of each sub-band. Then, the high-range coding circuit 24 computes the average value of the energies of each sub-band within the scalefactor band, and takes the computed average value of energies as the high-range scalefactor band energy Eobj of that scalefactor band. Thus, the high-range scalefactor band energies, that is, energy information, Eobj1 to Eobj7 in FIG. 5, for example, are calculated.

In a step S15, the high-range coding circuit 24 codes the high-range scalefactor band energies Eobj for a plurality of scalefactor bands, that is, energy information, according to a given coding scheme, and generates SBR information. For example, the high-range scalefactor band energies Eobj are coded according to scalar quantization, differential coding, variable-length coding, or other scheme. The high-range coding circuit 24 supplies the SBR information obtained by coding to the multiplexing circuit 25.

In a step S16, the multiplexing circuit 25 multiplexes the low-range coded data from the low-range coding circuit 22 and the SBR information from the high-range coding circuit 24, and outputs the bitstream obtained by multiplexing. The coding process ends.

In so doing, the encoder 11 codes an input signal, and outputs a bitstream multiplexed with low-range coded data and SBR information. Consequently, at the receiving side of this bitstream, the low-range coded data is decoded to obtain a low-range signal, that is a low-frequency range signal, while in addition, the low-range signal and the SBR information is used to generate a high-range signal, that is, a high-frequency range signal. An audio signal of wider band consisting of the low-range signal and the high-range signal can be obtained.

Decoder Configuration

Figure 8:
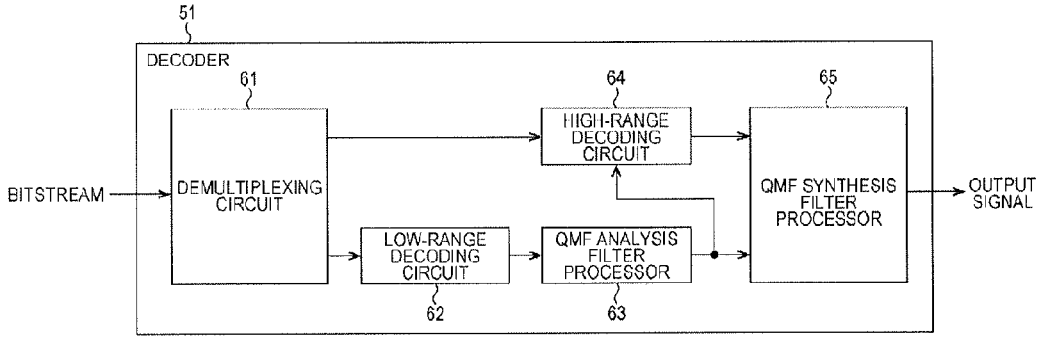
FIG. 8 is a diagram illustrating an exemplary configuration of an embodiment of a decoder to which an embodiment has been applied.

Next, a decoder that receives and decodes a bitstream output from the encoder 11 in FIG. 6 will be described. The decoder is configured as illustrated in FIG. 8, for example.

In other words, a decoder 51 consists of a demultiplexing circuit 61, a low-range decoding circuit 62, that is, a low-frequency range decoding circuit, a QMF analysis filter processor 63, a high-range decoding circuit 64, that is, a high-frequency range generating circuit, and a QMF synthesis filter processor 65, that is, a combinatorial circuit.

The demultiplexing circuit 61 demultiplexes a bitstream received from the encoder 11, and extracts low-range coded data and SBR information. The demultiplexing circuit 61 supplies the low-range coded data obtained by demultiplexing to the low-range decoding circuit 62, and supplies the SBR information obtained by demultiplexing to the high-range decoding circuit 64.

The low-range decoding circuit 62 decodes the low-range coded data supplied from the demultiplexing circuit 61 with a decoding scheme that corresponds to the low-range signal coding scheme (for example, the AAC scheme) used by the encoder 11, and supplies the low-range signal, that is, the low-frequency range signal, obtained as a result to the QMF analysis filter processor 63. The QMF analysis filter processor 63 conducts filter processing using a QMF analysis filter on the low-range signal supplied from the low-range decoding circuit 62, and extracts sub-band signals of the respective sub-bands on the low-range side from the low-range signal. In other words, band separation of the low-range signal is conducted. The QMF analysis filter processor 63 supplies the low-range sub-band signals, that is, low-frequency range band signals, of the respective sub-bands on the low-range side that were obtained by filter processing to the high-range decoding circuit 64 and the QMF synthesis filter processor 65.

Using the SBR information supplied from the demultiplexing circuit 61 and the low-range sub-band signals, that is, low-frequency range band signals, supplied from the QMF analysis filter processor 63, the high-range decoding circuit 64 generates high-range signals for respective scalefactor bands on the high-range side, and supplies them to the QMF synthesis filter processor 65.

The QMF synthesis filter processor 65 synthesizes, that is, combines, the low-range sub-band signals supplied from the QMF analysis filter processor 63 and the high-range signals supplied from the high-range decoding circuit 64 according to filter processing using a QMF synthesis filter, and generates an output signal. This output signal is an audio signal consisting of respective low-range and high-range sub-band components, and is output from the QMF synthesis filter processor 65 to a subsequent speaker or other playback unit.

Description of Decoding Process

If a bitstream from the encoder 11 is supplied to the decoder 51 illustrated in FIG. 8 and decoding of the bitstream is instructed, the decoder 51 conducts a decoding process and generates an output signal. Hereinafter, a decoding process by the decoder 51 will be described with reference to the flowchart in FIG. 9.

In a step S41, the demultiplexing circuit 61 demultiplexes the bitstream received from the encoder 11. Then, the demultiplexing circuit 61 supplies the low-range coded data obtained by demultiplexing the bitstream to the low-range decoding circuit 62, and in addition, supplies SBR information to the high-range decoding circuit 64.

In a step S42, the low-range decoding circuit 62 decodes the low-range coded data supplied from the low-range decoding circuit 62, and supplies the low-range signal, that is, the low-frequency range signal, obtained as a result to the QMF analysis filter processor 63.

In a step S43, the QMF analysis filter processor 63 conducts filter processing using a QMF analysis filter on the low-range signal supplied from the low-range decoding circuit 62. Then, the QMF analysis filter processor 63 supplies the low-range sub-band signals, that is low-frequency range band signals, of the respective sub-bands on the low-range side that were obtained by filter processing to the high-range decoding circuit 64 and the QMF synthesis filter processor 65.

In a step S44, the high-range decoding circuit 64 decodes the SBR information supplied from the low-range decoding circuit 62. Thus, high-range scalefactor band energies Eobj, that is, the energy information, of the respective scalefactor bands on the high-range side are obtained.

In a step S45, the high-range decoding circuit 64 conducts a flattening process, that is, a smoothing process, on the low-range sub-band signals supplied from the QMF analysis filter processor 63.

For example, for a particular scalefactor band on the high-range side, the high-range decoding circuit 64 takes the scalefactor band on the low-range side that is used to generate a high-range signal for that scalefactor band as the target scalefactor band for the flattening process. Herein, the scalefactor bands on the low-range that are used to generate high-range signals for the respective scalefactor bands on the high-range side are taken to be determined in advance.

Next, the high-range decoding circuit 64 conducts filter processing using a flattening filter on the low-range sub-band signals of the respective sub-bands constituting the processing target scalefactor band on the low-range side. More specifically, on the basis of the low-range sub-band signals of the respective sub-bands constituting the processing target scalefactor band on the low-range side, the high-range decoding circuit 64 computes the energies of those sub-bands, and computes the average value of the computed energies of the respective sub-bands as the average energy. The high-range decoding circuit 64 flattens the low-range sub-band signals of the respective sub-bands by multiplying the low-range sub-band signals of the respective sub-bands constituting the processing target scalefactor band by the ratios between the energies of those sub-bands and the average energy.

For example, assume that the scalefactor band taken as the processing target consists of the three sub-bands SB1 to SB3, and assume that the energies E1 to E3 are obtained as the energies of those sub-bands. In this case, the average value of the energies E1 to E3 of the sub-bands SB1 to SB3 is computed as the average energy EA.

Then, the values of the ratios of the energies, i.e. EA/E1, EA/E2, and EA/E3, are multiplied by the respective low-range sub-band signals of the sub-bands SB1 to SB3. In this way, a low-range sub-band signal multiplied by an energy ratio is taken to be a flattened low-range sub-band signal.

Herein, it may also be configured such that low-range sub-band signals are flattened by multiplying the ratio between the maximum value of the energies E1 to E3 and the energy of a sub-band by the low-range sub-band signal of that sub-band. Flattening of the low-range sub-band signals of respective sub-bands may be conducted in any manner as long as the power spectrum of a scalefactor band consisting of those sub-bands is flattened.

In so doing, for each scalefactor band on the high-range side intended to be generated henceforth, the low-range sub-band signals of the respective sub-bands constituting the scalefactor bands on the low-range side that are used to generate those scalefactor bands are flattened.

In a step S46, for the respective scalefactor bands on the low-range side that are used to generate scalefactor bands on the high-range side, the high-range decoding circuit 64 computes the average energies Eorg of those scalefactor bands.

More specifically, the high-range decoding circuit 64 computes the energies of the respective sub-bands by using the flattened low-range sub-band signals of the respective sub-bands constituting a scalefactor band on the low-range side, and additionally computes the average value of the those sub-band energies as an average energy Eorg.

In a step S47, the high-range decoding circuit 64 frequency-shifts the signals of the respective scalefactor bands on the low-range side, that is, low-frequency range band signals, that are used to generate scalefactor bands on the high-range side, that is, high-frequency range band signals, to the frequency bands of the scalefactor bands on the high-range side that are intended to be generated. In other words, the flattened low-range sub-band signals of the respective sub-bands constituting the scalefactor bands on the low-range side are frequency-shifted to generate high-frequency range band signals.

In a step S48, the high-range decoding circuit 64 gain-adjusts the frequency-shifted low-range sub-band signals according to the ratios between the High-range scalefactor band energies Eobj and the average energies Eorg, and generates high-range sub-band signals for the scalefactor bands on the high-range side.

For example, assume that a scalefactor band on the high-range that is intended to be generated henceforth is designated a high-range scalefactor band, and that a scalefactor band on the low-range side that is used to generate that high-range scalefactor band is called a low-range scalefactor band.

The high-range decoding circuit 64 gain-adjusts the flattened low-range sub-band signals such that the average value of the energies of the frequency-shifted low-range sub-band signals of the respective sub-bands constituting the low-range scalefactor band becomes nearly the same magnitude as the high-range scalefactor band energy of the high-range scalefactor band.

In so doing, frequency-shifted and gain-adjusted low-range sub-band signals are taken to be high-range sub-band signals for the respective sub-bands of a high-range scalefactor band, and a signal consisting of the high-range sub-band signals of the respective sub-bands of a scalefactor band on the high range side is taken to be a scalefactor band signal on the high-range side (high-range signal). The high-range decoding circuit 64 supplies the generated high-range signals of the respective scalefactor bands on the high-range side to the QMF synthesis filter processor 65.

In a step S49, the QMF synthesis filter processor 65 synthesizes, that is, combines, the low-range sub-band signals supplied from the QMF analysis filter processor 63 and the high-range signals supplied from the high-range decoding circuit 64 according to filter processing using a QMF synthesis filter, and generates an output signal. Then, the QMF synthesis filter processor 65 outputs the generated output signal, and the decoding process ends.

In so doing, the decoder 51 flattens, that is, smoothes, low-range sub-band signals, and uses the flattened low-range sub-band signals and SBR information to generate high-range signals for respective scalefactor bands on the high-range side. In this way, by using flattened low-range sub-band signals to generate high-range signals, an output signal able to play back audio of higher audio quality can be easily obtained.

Herein, in the foregoing, all bands on the low-range side are described as being flattened, that is, smoothed. However, on the decoder 51 side, flattening may also be conducted only on a band where a depression occurs from among the low range. In such cases, low-range signals are used in the decoder 51, for example, and a frequency band where a depression occurs is detected.

Second Embodiment

Description of Coding Process

Also, the encoder 11 may also be configured to generate position information for a band where a depression occurs in the low range and information used to flatten that band, and output SBR information including that information. In such cases, the encoder 11 conducts the coding process illustrated in FIG. 10.

Hereinafter, a coding process will be described with reference to the flowchart in FIG. 10 for the case of outputting SBR information including position information, etc. of a band where a depression occurs.

Figure 7:
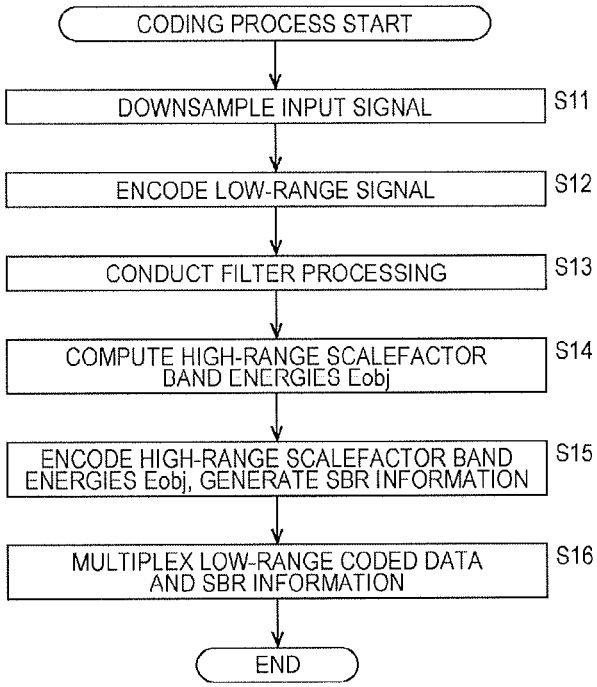
FIG. 7 is a flowchart explaining a coding process.

Herein, since the processing in step S71 to step S73 is similar to the processing in step S11 to step S13 in FIG. 7, its description is omitted or reduced. When the processing in step S73 is conducted, sub-band signals of respective sub-bands are supplied to the high-range coding circuit 24.

In a step S74, the high-range coding circuit 24 detects bands with a depression from among the low-range frequency bands, on the basis of the low-range sub-band signals of the sub-bands on the low-range side that were supplied from the QMF analysis filter processor 23.

More specifically, the high-range coding circuit 24 computes the average energy EL, i.e. the average value of the energies of the entire low range by computing the average value of the energies of the respective sub-bands in the low range, for example. Then, from among the sub-bands in the low range, the high-range coding circuit 24 detects sub-bands wherein the differential between the average energy EL and the sub-band energy becomes equal to or greater than a predetermined threshold value. In other words, sub-bands are detected for which the value obtained by subtracting the energy of the sub-band from the average energy EL is equal to or greater than a threshold value.

Furthermore, the high-range coding circuit 24 takes a band consisting of the above-described sub-bands for which the differential becomes equal to or greater than a threshold value, being also a band consisting of several consecutive sub-bands, as a band with a depression (hereinafter designated a flatten band). Herein, there may also be cases where a flatten band is a band consisting of one sub-band.

In a step S75, the high-range coding circuit 24 computes, for each flatten band, flatten position information indicating the position of a flatten band and flatten gain information used to flatten that flatten band. The high-range coding circuit 24 takes information consisting of the flatten position information and the flatten gain information for each flatten band as flatten information.

More specifically, the high-range coding circuit 24 takes information indicating a band taken to be a flatten band as flatten position information. Also, the high-range coding circuit 24 calculates, for each sub-band constituting a flatten band, the differential DE between the average energy EL and the energy of that sub-band, and takes information consisting of the differential DE of each sub-band constituting a flatten band as flatten gain information.

In a step S76, the high-range coding circuit 24 computes the high-range scalefactor band energies Eobj of the respective scalefactor bands on the high-range side, on the basis of the sub-band signals supplied from the QMF analysis filter processor 23. Herein, in step S76, processing similar to step S14 in FIG. 7 is conducted.

In a step S77, the high-range coding circuit 24 codes the high-range scalefactor band energies Eobj of the respective scalefactor bands on the high-range side and the flatten information of the respective flatten bands according to a coding scheme such as scalar quantization, and generates SBR information. The high-range coding circuit 24 supplies the generated SBR information to the multiplexing circuit 25.

After that, the processing in a step S78 is conducted and the coding process ends, but since the processing in step S78 is similar to the processing in step S16 in FIG. 7, its description is omitted or reduced.

In so doing, the encoder 11 detects flatten bands from the low range, and outputs SBR information including flatten information used to flatten the respective flatten bands together with the low-range coded data. Thus, on the decoder 51 side, it becomes possible to more easily conduct flattening of flatten bands.

<Description of Decoding Process>

Figure 10:
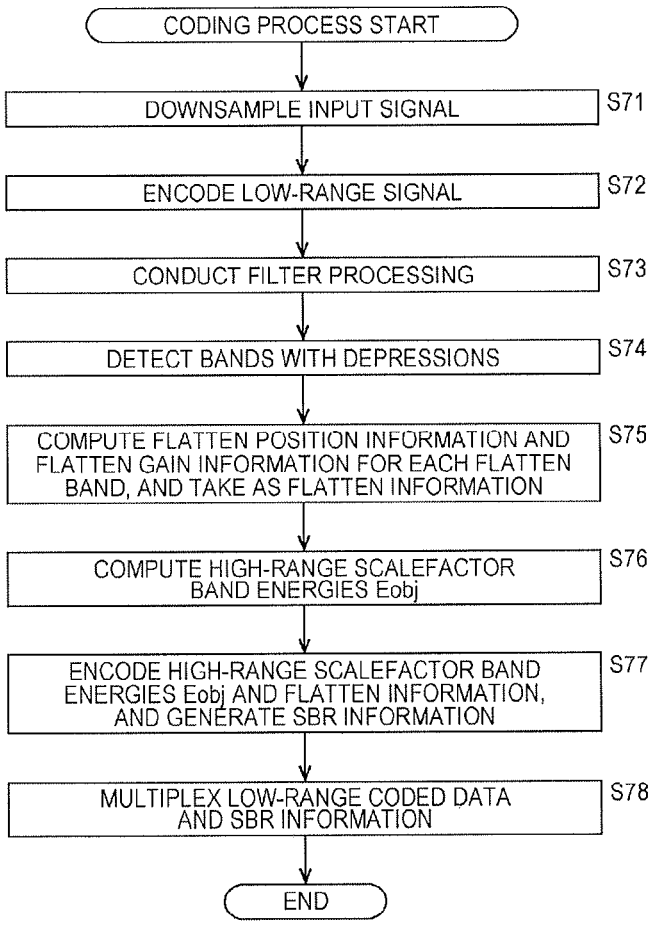
FIG. 10 is a flowchart explaining a coding process.

Also, if a bitstream output by the coding process described with reference to the flowchart in FIG. 10 is transmitted to the decoder 51, the decoder 51 that received that bitstream conducts the decoding process illustrated in FIG. 11. Hereinafter, a decoding process by the decoder 51 will be described with reference to the flowchart in FIG. 11.

Figure 9:
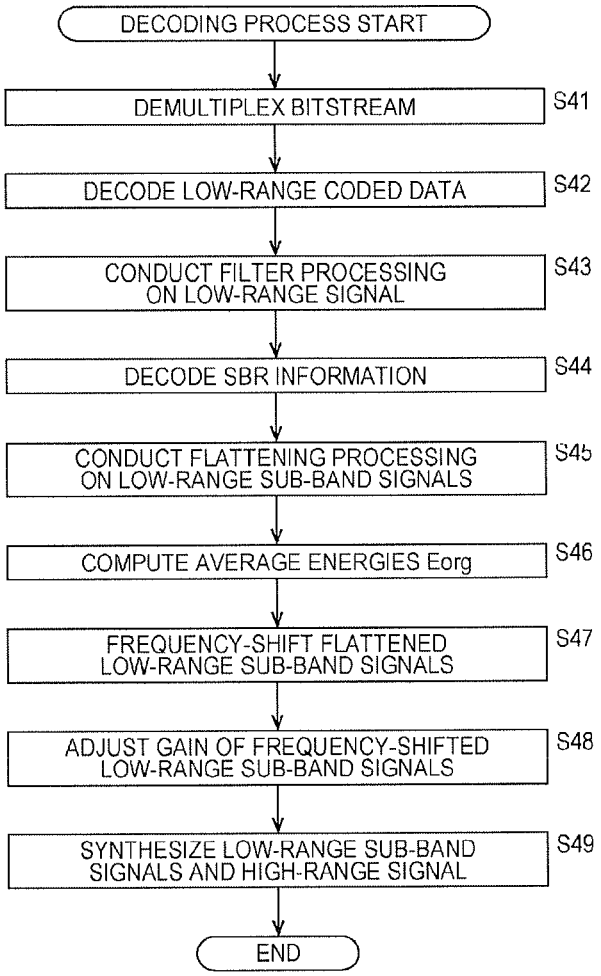
FIG. 9 is a flowchart explaining a decoding process.

Herein, since the processing in step S101 to step S104 is similar to the processing in step S41 to step S44 in FIG. 9, its description is omitted or reduced. However, in the processing in step S104, high-range scalefactor band energies Eobj and flatten information of the respective flatten bands is obtained by the decoding of SBR information.

In a step S105, the high-range decoding circuit 64 uses the flatten information to flatten the flatten bands indicated by the flatten position information included in the flatten information. In other words, the high-range decoding circuit 64 conducts flattening by adding the differential DE of a sub-band to the low-range sub-band signal of that sub-band constituting a flatten band indicated by the flatten position information. Herein, the differential DE for each sub-band of a flatten band is information included in the flatten information as flatten gain information.

In so doing, low-range sub-band signals of the respective sub-band constituting a flatten band from among the sub-bands on the low-range side are flattened. After that, the flattened low-range sub-band signals are used, the processing in step S106 to step S109 is conducted, and the decoding process ends. Herein, since this processing in step S106 to step S109 is similar to the processing in step S46 to step S49 in FIG. 9, its description is omitted or reduced.

In so doing, the decoder 51 uses flatten information included in SBR information, conducts flattening of flatten bands, and generates high-range signals for respective scalefactor bands on the high-range side. By conducting flattening of flatten bands using flatten information in this way, high-range signals can be generated more easily and rapidly.

Third Embodiment

Description of Coding Process

Also, in the second embodiment, flatten information is described as being included in SBR information as-is and transmitted to the decoder 51. However, it may also be configured such that flatten information is vector quantized and included in SBR information.

In such cases, the high-range coding circuit 24 of the encoder 11 logs a position table in which are associated a plurality of flatten position information vectors, that is, smoothing position information, and position indices specifying those flatten position information vectors, for example. Herein, a flatten information position vector is a vector taking respective flatten position information of one or a plurality of flatten bands as its elements, and is a vector obtained by arraying that flatten position information in order of lowest flatten band frequency.

Herein, not only mutually different flatten position information vectors consisting of the same numbers of elements, but also a plurality of flatten position information vectors consisting of mutually different numbers of elements are logged in the position table.

Furthermore, the high-range coding circuit 24 of the encoder 11 logs a gain table in which are associated a plurality of flatten gain information vectors and gain indices specifying those flatten gain information vectors. Herein, a flatten gain information vector is a vector taking respective flatten gain information of one or a plurality of flatten bands as its elements, and is a vector obtained by arraying that flatten gain information in order of lowest flatten band frequency.

Similarly to the case of the position table, not only a plurality of mutually different flatten gain information vectors consisting of the same numbers of elements, but also a plurality of flatten gain information vectors consisting of mutually different numbers of elements are logged in the gain table.

Figure 12:
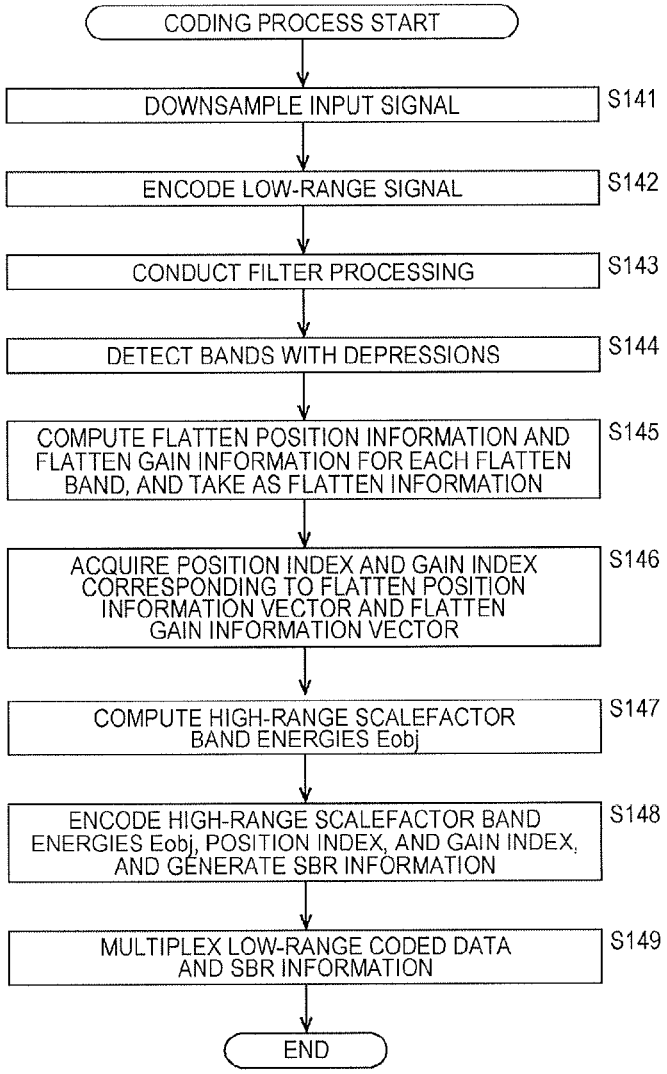
FIG. 12 is a flowchart explaining a coding process.

In the case where a position table and a gain table are logged in the encoder 11 in this way, the encoder 11 conducts the coding process illustrated in FIG. 12. Hereinafter, a coding process by the encoder 11 will be described with reference to the flowchart in FIG. 12.

Herein, since the respective processing in step S141 to step S145 is similar to the respective step S71 to step S75 in FIG. 10, its description is omitted or reduced.

If the processing in a step S145 is conducted, flatten position information and flatten gain information is obtained for respective flatten bands in the low range of an input signal. Then, the high-range coding circuit 24 arrays the flatten position information of the respective flatten bands in order of lowest frequency band and takes it as a flatten position information vector, while in addition, arrays the flatten gain information of the respective flatten bands in order of lowest frequency band and takes it as a flatten gain information vector.

In a step S146, the high-range coding circuit 24 acquires a position index and a gain index corresponding to the obtained flatten position information vector and flatten gain information vector.

In other words, from among the flatten position information vectors logged in the position table, the high-range coding circuit 24 specifies the flatten position information vector with the shortest Euclidean distance to the flatten position information vector obtained in step S145. Then, from the position table, the high-range coding circuit 24 acquires the position index associated with the specified flatten position information vector.

Similarly, from among the flatten gain information vectors logged in the gain table, the high-range coding circuit 24 specifies the flatten gain information vector with the shortest Euclidean distance to the flatten gain information vector obtained in step S145. Then, from the gain table, the high-range coding circuit 24 acquires the gain index associated with the specified flatten gain information vector.

In so doing, if a position index and a gain index are acquired, the processing in a step S147 is subsequently conducted, and high-range scalefactor band energies Eobj for respective scalefactor bands on the high-range side are calculated. Herein, since the processing in step S147 is similar to the processing in step S76 in FIG. 10, its description is omitted or reduced.

In a step S148, the high-range coding circuit 24 codes the respective high-range scalefactor band energies Eobj as well as the position index and gain index acquired in step S146 according to a coding scheme such as scalar quantization, and generates SBR information. The high-range coding circuit 24 supplies the generated SBR information to the multiplexing circuit 25.

After that, the processing in a step S149 is conducted and the coding process ends, but since the processing in step S149 is similar to the processing in step S78 in FIG. 10, its description is omitted or reduced.

In so doing, the encoder 11 detects flatten bands from the low range, and outputs SBR information including a position index and a gain index for obtaining flatten information used to flatten the respective flatten bands together with the low-range coded data. Thus, the amount of information in a bitstream output from the encoder 11 can be decreased.

<Description of Decoding Process>

Also, in the case where a position index and a gain index are included in SBR information, a position table and a gain table are logged in advance the high-range decoding circuit 64 of the decoder 51.

Figure 13:
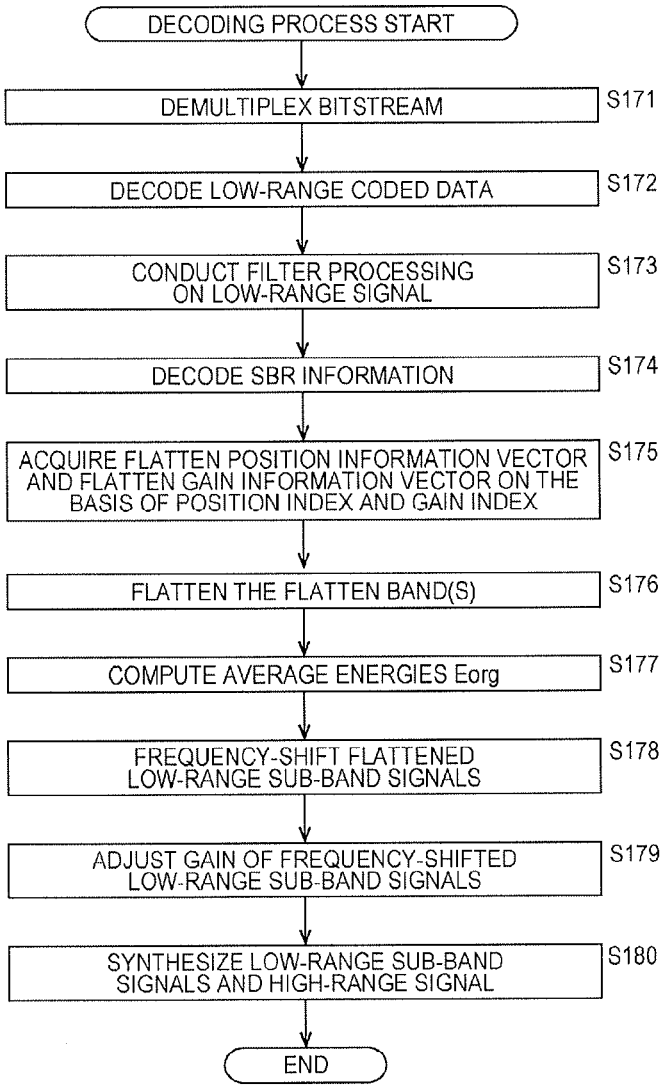
FIG. 13 is a flowchart explaining a decoding process.

In this way, in the case where the decoder 51 logs a position table and a gain table, the decoder 51 conducts the decoding process illustrated in FIG. 13. Hereinafter, a decoding process by the decoder 51 will be described with reference to the flowchart in FIG. 13.

Figure 11:
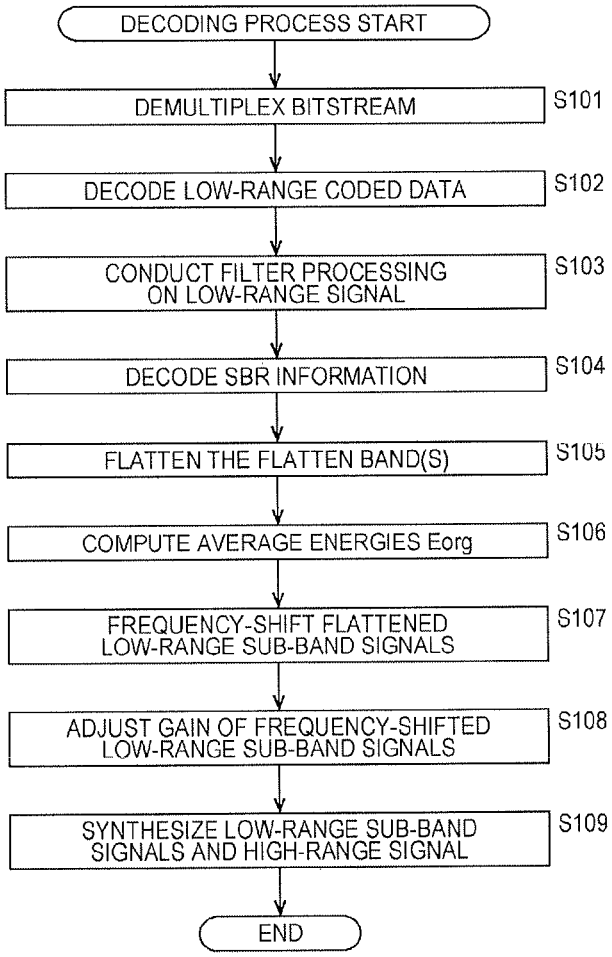
FIG. 11 is a flowchart explaining a decoding process.

Herein, since the processing in step S171 to step S174 is similar to the processing in step S101 to step S104 in FIG. 11, its description is omitted or reduced. However, in the processing in step S174, high-range scalefactor band energies Eobj as well as a position index and a gain index are obtained by the decoding of SBR information.

In a step S175, the high-range decoding circuit 64 acquires a flatten position information vector and a flatten gain information vector on the basis of the position index and the gain index.

In other words, the high-range decoding circuit 64 acquires from the logged position table the flatten position information vector associated with the position index obtained by decoding, and acquires from the gain table the flatten gain information vector associated with the gain index obtained by decoding. From the flatten position information vector and the flatten gain information vector obtained in this way, flatten information of respective flatten bands, i.e. flatten position information and flatten gain information of respective flatten bands, is obtained.

If flatten information of respective flatten bands is obtained, then after that the processing in step S176 to step S180 is conducted and the decoding process ends, but since this processing is similar to the processing in step S105 to step S109 in FIG. 11, its description is omitted or reduced.

In so doing, the decoder 51 conducts flattening of flatten bands by obtaining flatten information of respective flatten bands from a position index and a gain index included in SBR information, and generates high-range signals for respective scalefactor bands on the high-range side. By obtaining flatten information from a position index and a gain index in this way, the amount of information in a received bitstream can be decreased.

The above-described series of processes can be executed by hardware or executed by software. In the case of executing the series of processes by software, a program constituting such software in installed from a program recording medium onto a computer built into special-purpose hardware, or alternatively, onto for example a general-purpose personal computer, etc. able to execute various functions by installing various programs.

Figure 14:
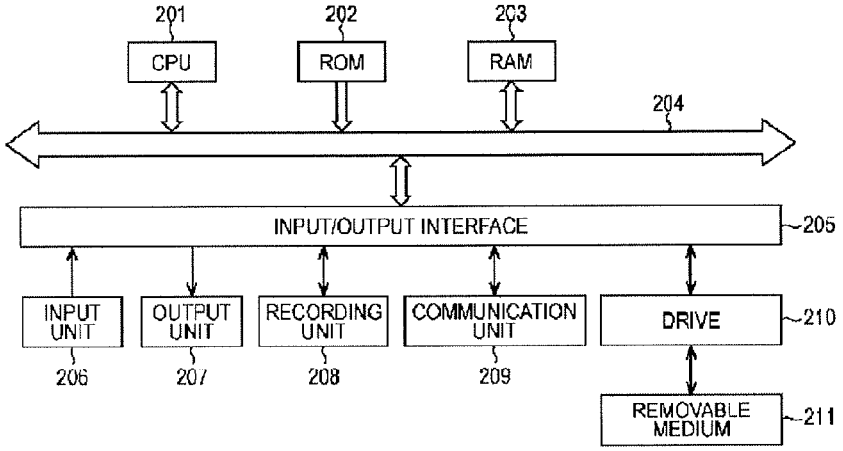
FIG. 14 is a block diagram illustrating an exemplary configuration of a computer.

FIG. 14 is a block diagram illustrating an exemplary hardware configuration of a computer that executes the above-described series of processes according to a program.

In a computer, a CPU (Central Processing Unit) 201, ROM (Read Only Memory) 202, and RAM (Random Access Memory) 203 are coupled to each other by a bus 204.

Additionally, an input/output interface 205 is coupled to the bus 204. Coupled to the input/output interface 205 are an input unit 206 consisting of a keyboard, mouse, mi-crophone, etc., an output unit 207 consisting of a display, speakers, etc., a recording unit 208 consisting of a hard disk, non-volatile memory, etc., a communication unit 209 consisting of a network interface, etc., and a drive 210 that drives a removable medium 211 such as a magnetic disk, an optical disc, a magneto-optical disc, or semi-conductor memory.

In a computer configured like the above, the above-described series of processes is conducted due to the CPU 201 loading a program recorded in the recording unit 208 into the RAM 203 via the input/output interface 205 and bus 204 and executing the program, for example.

The program executed by the computer (CPU 201) is for example recorded onto the removable medium 211, which is packaged media consisting of magnetic disks (including flexible disks), optical discs (CD-ROM (Compact Disc-Read Only Memory), DVD (Digital Versatile Disc), etc.), magneto-optical discs, or semi-conductor memory, etc. Alternatively, the program is provided via a wired or wireless transmission medium such as a local area network, the Internet, or digital satellite broadcasting.

Additionally, the program can be installed onto the recording unit 208 via the input/output interface 205 by loading the removable medium 211 into the drive 210. Also, the program can be received at the communication unit 209 via a wired or wireless transmission medium, and installed onto the recording unit 208. Otherwise, the program can be pre-installed in the ROM 202 or the recording unit 208.

Herein, a program executed by a computer may be a program wherein processes are conducted in a time series following the order described in the present specification, or a program wherein processes are conducted in parallel or at required timings, such as when a call is conducted.

Herein, embodiments are not limited to the above-described embodiments, and various modifications are possible within a scope that does not depart from the principal matter.

REFERENCE SIGNS LIST

11 encoder
22 low-range coding circuit, that is, a low-frequency range coding circuit;
24 high-range coding circuit, that is, a high-frequency range coding circuit
25 multiplexing circuit
51 decoder
61 demultiplexing circuit
63 QMF analysis filter processor
64 high-range decoding circuit, that is, a high-frequency range generating circuit
65 QMF synthesis filter processor, that is, a combinatorial circuit

The invention claimed is:

1. A computer-implemented method for processing an audio signal, the method comprising:

receiving an encoded low-frequency range signal corresponding to the audio signal;

decoding the encoded signal to produce a decoded signal having an energy spectrum of a shape including an energy depression;

performing filter processing on the decoded signal, the filter processing separating the decoded signal into low-frequency range band signals;

performing a smoothing process on the low-frequency range band signals, the smoothing process smoothing the energy depression of the low-frequency range band signals;

performing a frequency shift on the smoothed low-frequency range band signals, the frequency shift generating high-frequency range band signals from the low-frequency range band signals;

combining the low-frequency range band signals and the high-frequency range band signals to generate an output signal; and outputting the output signal, wherein performing the smoothing process on the low-frequency range band signals further comprises:

computing an average energy of a plurality of low-frequency range band signals;

computing a ratio for a selected one of the low-frequency range band signals by computing a ratio of the average energy of the plurality of low-frequency range band signals to an energy for the selected low-frequency range band signal; and multiplying the selected low-frequency range band signal by the computed ratio.

2. A device for processing an audio signal, the device comprising:

a low-frequency range decoding circuit configured to receive an encoded low-frequency range signal corresponding to the audio signal and decode the encoded signal to produce a decoded signal having an energy spectrum of a shape including an energy depression;

a filter processor configured to perform filter processing on the decoded signal, the filter processing separating the decoded signal into low-frequency range band signals;

a high-frequency range generating circuit configured to:

perform a smoothing process on the low-frequency range band signals, the smoothing process smoothing the energy depression; and perform a frequency shift on the smoothed low-frequency range band signals, the frequency shift generating high-frequency range band signals from the low-frequency range band signals; and a combinatorial circuit configured to combine the low-frequency range band signals and the high-frequency range band signals to generate an output signal, and output the output signal, wherein the high-frequency range generating circuit is further configured to perform the smoothing process on the low-frequency range band signals by:

computing an average energy of a plurality of low-frequency range band signals;

computing a ratio for a selected one of the low-frequency range band signals by computing a ratio of the average energy of the plurality of low-frequency range band signals to an energy for the selected low-frequency range band signal; and multiplying the selected low-frequency range band signal by the computed ratio.

3. A non-transitory computer-readable storage medium including instructions that, when executed by a processor, perform a method for processing an audio signal, the method comprising:

receiving an encoded low-frequency range signal corresponding to the audio signal;

decoding the encoded signal to produce a decoded signal having an energy spectrum of a shape including an energy depression;

performing filter processing on the decoded signal, the filter processing separating the decoded signal into low-frequency range band signals;

performing a smoothing process on the low-frequency range band signals, the smoothing process smoothing the energy depression of the decoded signal;

performing a frequency shift on the smoothed low-frequency range band signals, the frequency shift generating high-frequency range band signals from the low-frequency range band signals;

combining the low-frequency range band signals and the high-frequency range band signals to generate an output signal; and outputting the output signal, wherein performing the smoothing process on the low-frequency range band signals further comprises:

computing an average energy of a plurality of low-frequency range band signals;

computing a ratio for a selected one of the low-frequency range band signals by computing a ratio of the average energy of the plurality of low-frequency range band signals to an energy for the selected low-frequency range band signal; and multiplying the selected low-frequency range band signal by the computed ratio.

* * * * *